US007784783B2

(12) United States Patent
Teo et al.

(10) Patent No.: US 7,784,783 B2
(45) Date of Patent: Aug. 31, 2010

(54) DUPLEX SYSTEM FOR AN INKJET PRINTER

(75) Inventors: Cherng Linn Teo, Singapore (SG); Dennis Chua, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 1352 days.

(21) Appl. No.: 10/808,224

(22) Filed: Mar. 23, 2004

(65) Prior Publication Data

US 2005/0212197 A1 Sep. 29, 2005

(51) Int. Cl.
*B65H 85/00* (2006.01)

(52) U.S. Cl. ..... 271/186; 271/65

(58) Field of Classification Search ..... 271/65, 271/186, 902, 301; 399/110, 107, 401, 364; 347/104; 355/24
See application file for complete search history.

(56) References Cited

U.S. PATENT DOCUMENTS

| | | | | |
|---|---|---|---|---|
| 4,660,963 | A * | 4/1987 | Stemmle | 355/24 |
| 4,924,275 | A | 5/1990 | Nelson | |
| 5,042,791 | A * | 8/1991 | Stemmle | 271/186 |
| 5,559,606 | A * | 9/1996 | Webster et al. | 358/296 |
| 5,655,174 | A * | 8/1997 | Hirst | 399/27 |
| 5,772,343 | A | 6/1998 | Beretta | |
| 5,937,262 | A * | 8/1999 | Cho | 399/401 |
| 5,974,298 | A | 10/1999 | Urban | |
| 5,988,906 | A * | 11/1999 | Arcaro et al. | 400/636.2 |
| 6,029,020 | A * | 2/2000 | Blackman et al. | 399/45 |
| 6,463,256 | B2 | 10/2002 | Blackman | |
| 7,055,820 | B2 * | 6/2006 | Saito et al. | 271/298 |
| 7,062,196 | B2 * | 6/2006 | Nanno | 399/107 |
| 2005/0189709 | A1 * | 9/2005 | Bokelman et al. | 271/265.01 |
| 2006/0023005 | A1 * | 2/2006 | Katsuyama et al. | 347/1 |
| 2006/0164491 | A1 * | 7/2006 | Sakuma et al. | 347/104 |

FOREIGN PATENT DOCUMENTS

| | | |
|---|---|---|
| JP | 63-165165 | 7/1988 |
| JP | 64-063182 | 3/1989 |
| JP | 2003-154643 | 5/2003 |

OTHER PUBLICATIONS

Page 78 with the definition of "adjacent" from Webster's II New Riverside University Dictionary (1984).*

* cited by examiner

*Primary Examiner*—Saúl J Rodríguez
*Assistant Examiner*—Thomas A Morrison

(57) ABSTRACT

A duplex system for an inkjet printer having a printhead for printing a media sheet is disclosed. The duplex system includes a front duplex module and a back duplex module detachably coupled to the front duplex module. The front duplex module includes a first roller assembly for advancing the media sheet to the printhead along a simplex media path and a second roller assembly disposed along the simplex media path for handling the media sheet.

5 Claims, 3 Drawing Sheets

DUPLEX SYSTEM FOR AN INKJET PRINTER

FIELD OF INVENTION

The present invention relates generally to duplex media sheet handling systems for printers. Specifically, it relates to a duplex system for an inkjet printer having small form factor for printing duplex media sheets with zero bottom of form margin.

BACKGROUND OF THE INVENTION

Duplex printing is a desirable feature in printing systems. The advantages of duplex printing include reducing the amount of paper required as compared to one-side (simplex) printing, and generating print sets with layouts resembling that of professionally printed books. Modern duplex printing is typically accomplished by using one of two types of duplex system employed in printing systems, such as inkjet printers. The two types of duplex systems are back and front duplex systems as shown respectively in FIGS. 1 and 2.

FIG. 1 shows a prior art back duplex system 100 for an inkjet printer. The back duplex system 100 includes a duplex module 102, a linefeed roller assembly 104, and a printhead 106. The general operation of the back duplex system 100 is such that a media sheet 112, such as a printing paper, is fed via a media path entry 110 and received by the linefeed roller assembly 104. The linefeed roller assembly 104 subsequently feeds the media sheet 112 to the printhead 106 for printing on a first side of the media sheet 112. Once printing on the first side of the media sheet is completed, the linefeed roller assembly 104 rolls the media sheet 112 in the reverse direction into a duplex media path entry 114 of the duplex module 102. The media sheet 112 is directed through the duplex media path 116 in the duplex module 102 by two rollers 120 and 122 and back to the linefeed roller assembly 104 via a duplex media path exit 118. The linefeed roller assembly 104 then forwards the media sheet 112 to the printhead 106 for printing on a second side of the media sheet 112.

Although the back duplex module 102 may be installed only when duplex printing is required, the duplex system 100 suffers from not being able to print all the way to the trailing edge 124 of the media sheet 112. The portion of the unprintable area on the media sheet is commonly referred to as "bottom of form" 108 as shown in FIG. 1. The bottom of form 108 margin, typically between 10 to 13 millimeters, is defined by the distance between the trailing edge 124 of the media sheet 118 and the first array of nozzles (not shown) of the printhead 106.

The front duplex system has a duplex module typically housed inside the base of the printer. Thus, the overall size or form factor of the printer remains the same even when the duplex module is removed. The front duplex system overcomes the bottom of form limitation but suffers from large form factor which consumes valuable table space as described herein with reference to FIG. 2. FIG. 2 shows a prior art front duplex system 200 for an inkjet printer. The front duplex system 200 includes a duplex module 202, a linefeed roller assembly 204, a printhead 206, and an output roller assembly 208. A media sheet 212 is fed via a media path entry 210 and received by the linefeed roller assembly 204. The linefeed roller assembly 204 subsequently feeds the media sheet 212 to the printhead 206 for printing on a first side of the media sheet 212.

As the printhead 206 prints, the media sheet 212 is progressively advanced forward and eventually received by the output roller assembly 208. Once printing on the first side of the media sheet 212 is completed, the output roller assembly 208 further advances the media sheet 212 forward until the trailing edge 218 of the media sheet 212 reaches the duplex media path entry 214 area. The output roller assembly 208 then reverses the rolling direction and rolls the media sheet 212 into the duplex media path entry 214. The media sheet 212 is advanced along a duplex media path 216 to the linefeed roller assembly 204 where the media sheet 212 is received and subsequently fed to the printhead 206 for printing on a second side of the media sheet 212.

In the front duplex system 200, the transmission (i.e. the set of gears and belts that drives the rollers) of the output roller assembly 208 is coupled to the transmission of the linefeed roller assembly 204 in order to maintain media sheet 212 feeding accuracy.

Thus, during duplexing (i.e. the process of flipping the media sheet), the trailing edge, which is the leading edge 220 during duplexing, of the media sheet 212 must leaves the output roller assembly 208 before the media sheet 212 is further advanced along the duplex media path by a transfer roller assembly 222 to the linefeed roller assembly 204. This is so because the turning direction of the rollers of the two roller assemblies 204 and 208 are in opposite directions to each other.

This requirement causes the front duplex system 200 to have a large form factor. The form factor is dependent on the size of the media sheet the printer is designed to accommodate. For example, if the media sheet is of A4 size, then the reverse duplex media path length (i.e. the duplex media path entry 214 and the duplex media path 216) between the linefeed roller assembly 204 and the output roller assembly 208 must be longer than the length of the A4 size media sheet. However, if the transmissions of the linefeed roller assembly 204 and output roller assembly 208 can be decoupled, the form factor can be reduced and is only limited by the loop of the media sheet path starting and ending at the output roller assembly 208. Thus, the form factor of the printer of the decoupled transmissions of the linefeed roller assembly 204 and output roller assembly 208 is smaller but still has substantial impact to the base printer size. Further, decoupling the transmissions of the two roller assemblies 204 and 208 is difficult and may be costly.

Therefore, there is clearly a need to provide a duplex system for an inkjet printer that addresses the above-outlined shortcomings of existing duplex systems.

SUMMARY OF THE INVENTION

The present invention is directed to a duplex system for an inkjet printer having a printhead for printing a media sheet. The duplex system includes a front duplex module and a back duplex module detachably coupled to the front duplex module. The front duplex module includes a first roller assembly for advancing the media sheet to the printhead along a simplex media path and a second roller assembly disposed along the simplex media path for handling the media sheet.

BRIEF DESCRIPTION OF THE DRAWINGS

Embodiments of the invention are herein described, purely by way of example, with reference to the accompanying drawings, in which.

DETAILED DESCRIPTION OF THE INVENTION

A duplex system for an inkjet printer having substantially small form factor and a method for printing a media sheet on both sides with zero bottom of form margin using the inkjet printer are described hereinafter.

Figure 1:
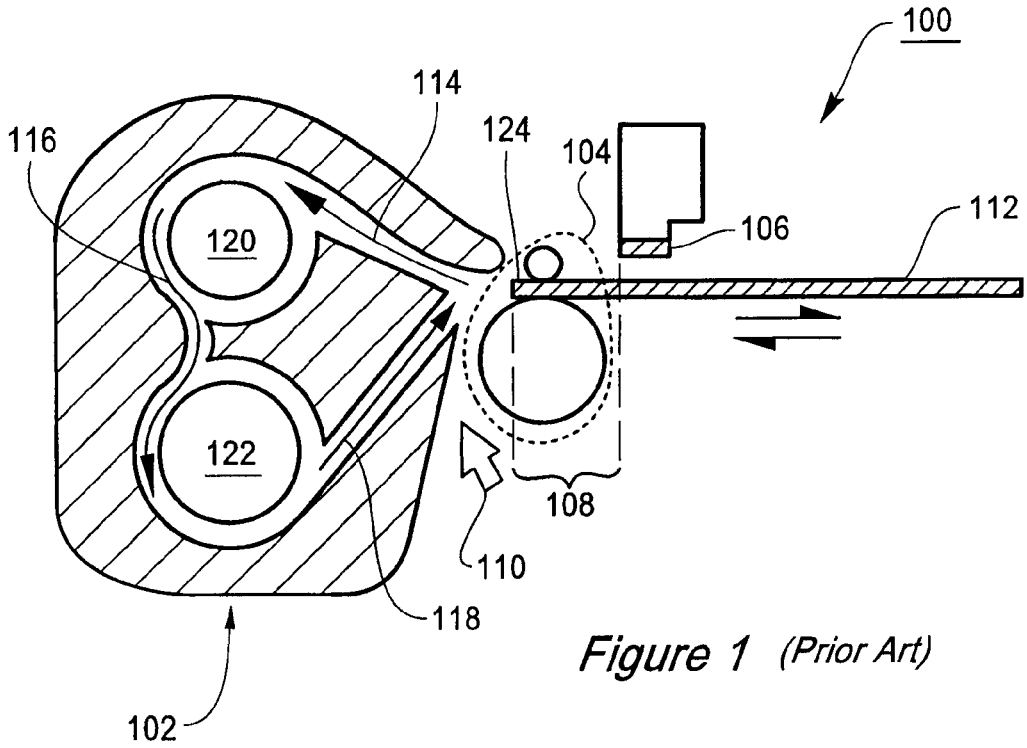
Figure 1 (Prior Art)
FIG. 1 shows a side cross sectional view of a prior art back duplex system for an inkjet printer.
Figure 2:
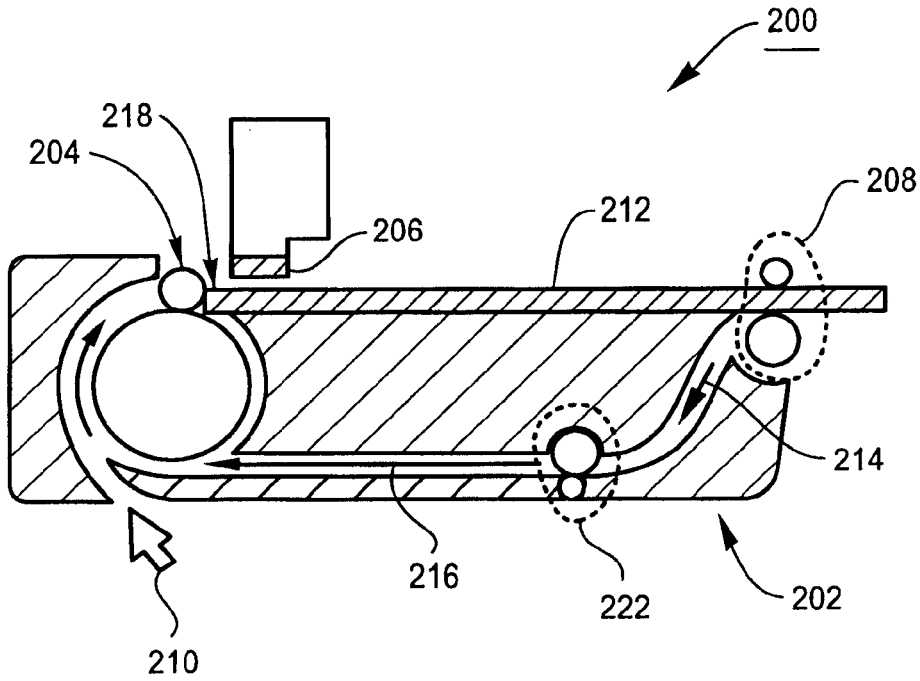
Figure 2 (Prior Art)
FIG. 2 shows a side cross sectional view of a prior art front duplex system for an inkjet printer.
Figure 3A:
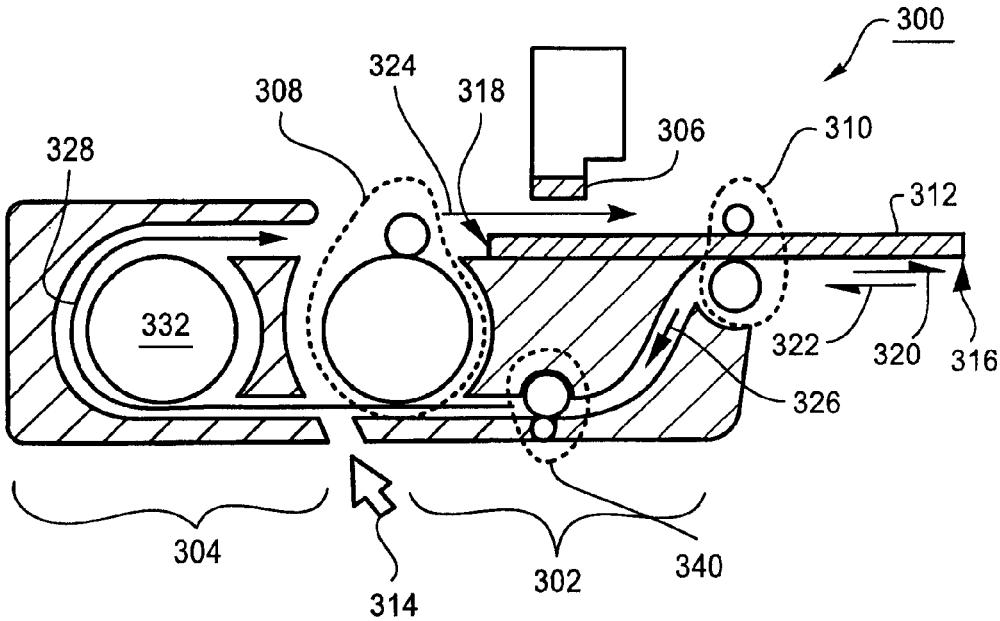
FIG. 3A shows a side cross sectional view of a duplex system for an inkjet printer according to an embodiment of the present invention.

A duplex system 300 according to an embodiment is shown in FIG. 3A. The duplex system 300 includes a front duplex module 302, a printhead 306, and a back duplex module 304 which is detachably connected to the front duplex module 302. The front duplex module 302 includes a linefeed roller assembly 308 and an output roller assembly 310. The linefeed roller assembly 308 is coupled to the output roller assembly 310 to provide a coordinated control for advancing a media sheet 312. The printhead 306 is disposed between the linefeed roller assembly 308 and the output roller assembly 310 as shown in FIG. 3A. The distal displacement between the linefeed roller assembly 308 and the output roller assembly 310 is not restricted to a particular dimension or the length of the media sheet. The distal displacement can be as small as permitted by the mechanical constraint of the assembled linefeed roller assembly 308, printhead 306 and mechanical structures related thereto (not shown) for operating the printhead 306, and output roller assembly 310. Thus, the front duplex module 302 can accommodate any media sheet size without constraining the form factor of the printer to a large size.

Typical operation of the front duplex module 302 is such that the media sheet 312 is fed to the linefeed roller assembly 308 via a media sheet path entry 314. The linefeed roller assembly 308 subsequently advances forward the media sheet 312 along a simplex media path 324 to the printhead 306 for printing on a first side of the media sheet 312. When the leading edge 316 of the media sheet 312 reaches the output roller assembly 310, the linefeed roller assembly 308 and the output roller assembly 310 advances the media sheet 312 together. Once the trailing edge 318 of the media sheet 312 leaves the linefeed roller assembly 308, the output roller assembly 310 takes over the task of further advancing forward 320 the media sheet 312 until printing on the first side of the media sheet 312 is completed. If the transmission between the output and linefeed roller assembly are not coupled together, complicated (if possible at all) control is needed to ensure the two roller assemblies 308 and 310 synchronize with each other and advance the media sheet 312 with substantially identical motion profile in order to achieve good feeding accuracy. Accordingly, in an embodiment, the transmissions of the two roller assemblies 308 and 310 are coupled to provide coordinated control for handling the media sheet 312.

If printing on the second side of the media sheet 312 is not needed, the output roller assembly 310 simply rolls out the printed media sheet 312 to an output tray of the printer (not shown). Thus, base size of the printer is minimized and not restricted to the length of a media sheet. However, if duplex printing is needed, the media sheet 312 is fed back into a reverse duplex media path (i.e. a duplex media path entry 326 and a duplex media path 328) as described hereinafter.

Figure 3B:
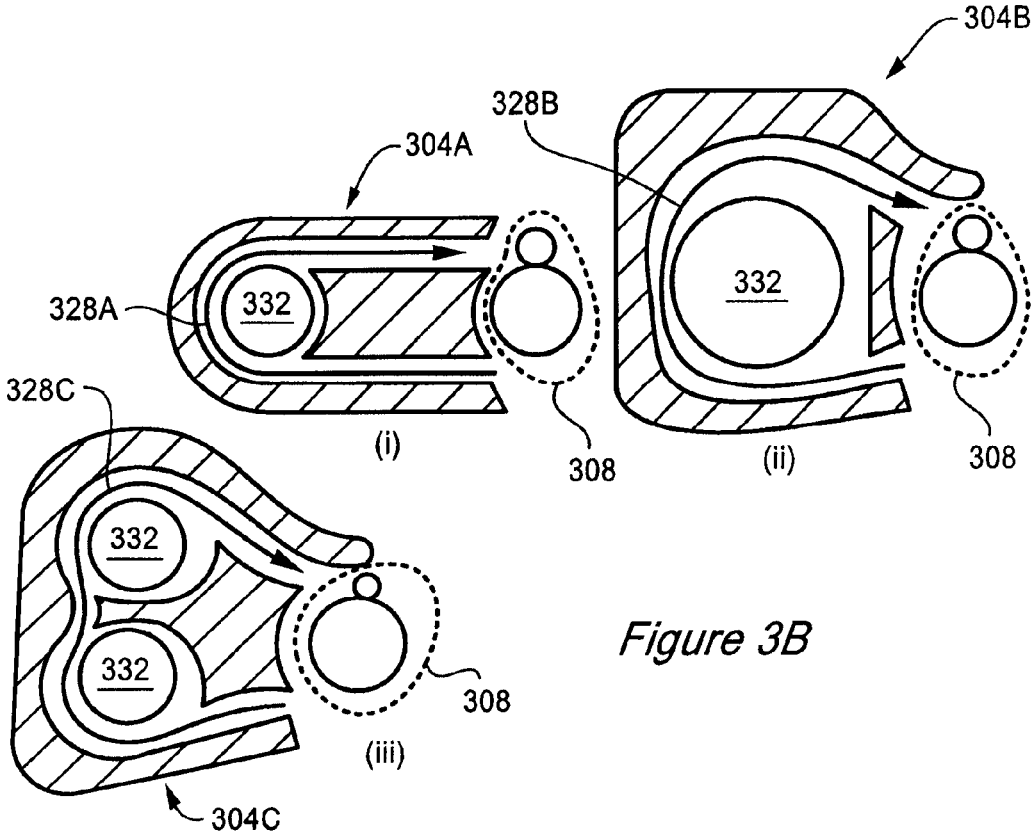
FIG. 3B shows side cross sectional views of three examples of an alternative back duplex module of the duplex system of FIG. 3A in accordance with an embodiment of the present invention.

The back duplex module 304 can be easily attached to the printer and operates in conjunction with the front duplex module 302 to provide duplex printing capability. Means for such detachable connection between two mechanical modules are well known in the art. The back duplex module 304 includes a duplex roller 332 for receiving and advancing the media sheet 312 along the duplex media path 328 to the linefeed roller assembly 308. The exit portion of the duplex media path 328 is aligned to the simplex media path 324. It is possible to change the number of duplex rollers, the diameters and positions thereof to achieve the required media path length. FIG. 3B shows 3 examples of alternative back duplex module 304.

FIG. 3B (i) shows an alternative back duplex module 304A wherein the position of the duplex roller 332 substantially located away from the linefeed roller assembly 308 to provide for a longer duplex media path 328A. FIG. 3B (ii) shows another alternative back duplex module 304B wherein the diameter of the duplex roller 332 is substantially increased and thus resulting in a longer duplex media path 328B. FIG. 3B (iii) shows yet another alternative back duplex module 304C wherein two duplex rollers 332 are arranged adjacent to each other to provide for a longer duplex media path 328C.

Figure 4:
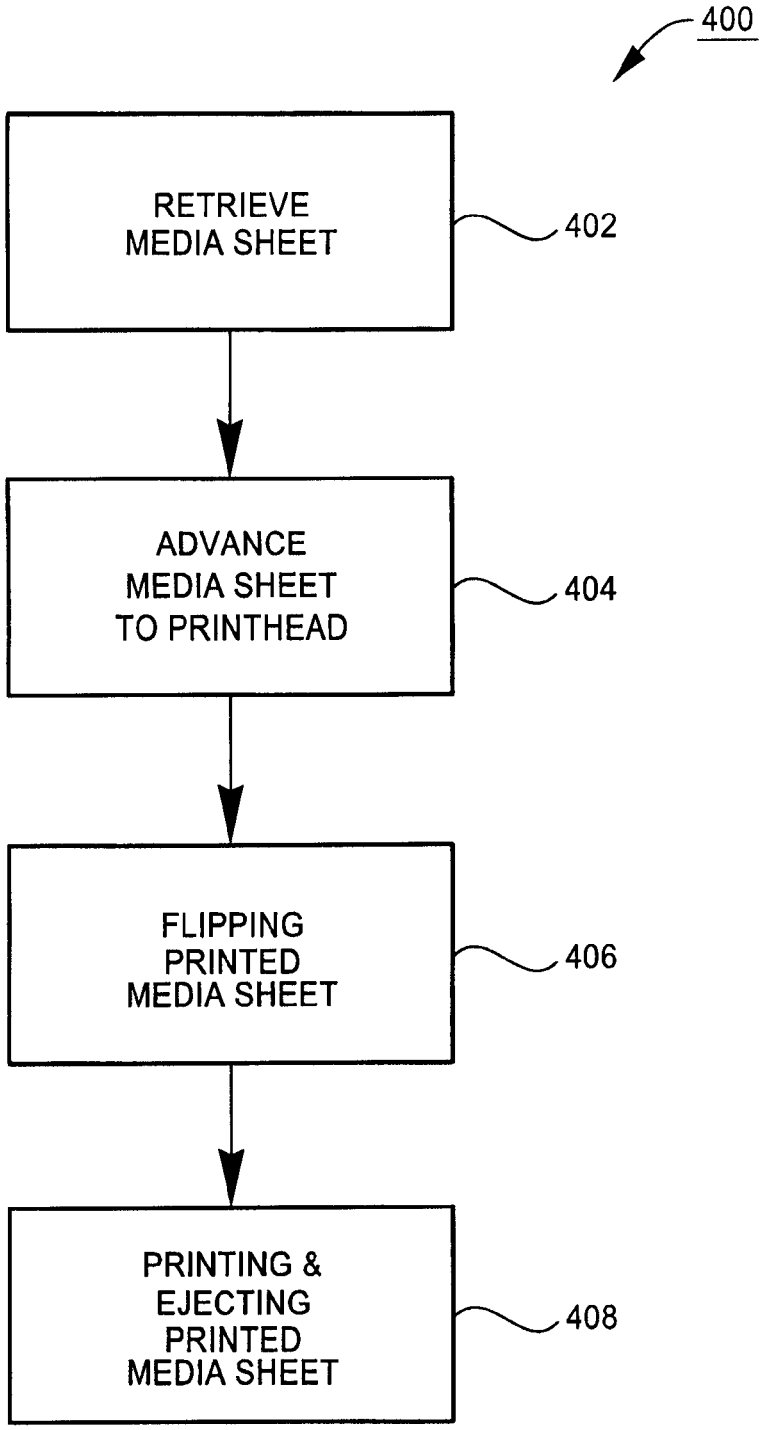
FIG. 4 shows a flowchart for printing a media sheet with zero bottom of form margin using the duplex system of FIG. 3A in accordance with an embodiment of the present invention.

FIG. 4 shows a flowchart 400 for duplex printing using an inkjet printer having the duplex system 300 of the present invention as described in the foregoing. For ease of reference, please refer to FIGS. 3 and 4 simultaneously. In a step 402, the media sheet 312 is retrieved from a media storage tray (not shown) and fed to the linefeed roller assembly 308 via the media path entry 314. The linefeed roller assembly 308 advances the media sheet 312 along the simplex media path 324 to the printhead for printing on a first side of the media sheet 312 in a step 404. In the step 404, the linefeed roller assembly 308 continues to advance forward 320 the media sheet 312. When the leading edge 318 of the media sheet 312 reaches the output roller assembly 310, the media sheet 312 is advanced by both the linefeed roller assembly 308 and output roller assembly 310 together.

Once the trailing edge 318 of the media sheet 312 leaves the linefeed roller assembly 308, the output roller assembly 310 takes over the task of advancing forward 320 the media sheet 312 as the printhead prints on the first side thereof. Thus, printing to the end of the length of the media sheet 312 is possible since the output roller assembly 310 is located downstream from the printhead 306 along the simplex media path 324.

Once printing on the first side of the media sheet 312 is completed and duplex printing is not needed, the output roller assembly 310 rolls out the printed media sheet 312 to an output tray of the printer (not shown). However, if duplex printing is needed, the media sheet 312 is flipped in a step 406.

In the step 406, the output roller assembly 310 advances forward 320 the media sheet 312 until the trailing edge 318 of the media sheet 312 reaches the duplex media path entry 326 area. The output roller assembly 310 then reverses the rolling direction and advances the printed media sheet 312 backward 322 into the duplex media path entry 326. As the media sheet 312 advances backward 322, a transfer roller assembly 340 advances the media sheet along the duplex media path 328 to the duplex roller 332. The duplex roller 332 subsequently advances the media sheet 312 to the linefeed roller assembly 308 with the media sheet 312 being flipped for printing on the second side thereof. In a step 408, once the second side of the media sheet 312 is printed in the same manner as the first side described in the foregoing, the output roller assembly 310 rolls out the printed media sheet 312 to the output tray (not shown) of the printer.

Although an embodiment of the invention is described in the foregoing, it is anticipated that individuals skilled in the art may make other modifications and equivalents thereto. Therefore, the foregoing description should not be taken as limiting the scope of the invention which is defined by the appended claims.

The invention claimed is:

1. An inkjet printer comprising:

a printhead for printing a media sheet;

a front duplex module comprising: (i) a media path entry where a media sheet to be printed can enter; (ii) a linefeed-roller assembly configured to transport the media sheet entering the media path entry toward the printhead to enable printing on a first side of the media sheet; (iii) an output-roller assembly configured to advance the media sheet in a forward direction or to reverse the media sheet in a reverse direction, wherein a simplex media path is defined between the linefeed-roller assembly and the output-roller assembly, and the printhead is positioned downstream from the linefeed-roller assembly along the simplex media path but upstream from the output roller assembly; and a back duplex module detachably coupled to the front duplex module, said back duplex module being configured to provide a single, unidirectional loop path for flipping the media sheet one time to thereby enable printing on a second side of the media sheet, wherein said loop path has an entry portion that is positioned next to the media path entry for receiving the media sheet from the front duplex module and an exit portion that is aligned to the simplex media path, wherein the front duplex module and the back duplex module are configured to provide a duplex media path that includes said loop path, and a duplex path entry that is positioned adjacent to the output-roller assembly but downstream from the printhead so as to enable a trailing edge of the media sheet to enter the duplex media path, and wherein a portion of the linefeed-roller assembly is positioned adjacent to the duplex media path such that, after the trailing edge of the media sheet entered through the duplex path entry, the trailing edge must bypass said portion of the linefeed-roller assembly and the media path entry before entering the loop path.

2. The inkjet printer of claim 1, wherein the linefeed-roller assembly and the output-roller assembly are coupled to each other to provide a coordinated control for handling the media sheet.

3. The inkjet printer of claim 1, wherein said back duplex module comprises a duplex roller arranged to advance the media sheet along said loop path toward the linefeed-roller assembly.

4. The inkjet printer of claim 1, wherein said back duplex module comprises two duplex rollers arranged to advance the media sheet along said loop path toward the linefeed-roller assembly.

5. The inkjet printer of claim 1, wherein said front duplex module further comprises a pair of transfer rollers arranged along the duplex media path to advance the media sheet along the duplex media path.

* * * * *